US005456380A

United States Patent [19]

Ito et al.

[11] Patent Number: 5,456,380

[45] Date of Patent: Oct. 10, 1995

[54] CAPS FOR DRINK CONTAINERS

[75] Inventors: Seiichi Ito; Toru Goto; Ikuo Miura; Yukari Kawamura, all of Tokyo, Japan

[73] Assignee: Nippon Sanso Corporation, Tokyo, Japan

[21] Appl. No.: 310,520

[22] Filed: Sep. 22, 1994

[30] Foreign Application Priority Data

Sep. 29, 1993 [JP] Japan ..... 5-242961

[51] Int. Cl.[6] ..... B65D 41/32

[52] U.S. Cl. ..... 220/713; 220/717; 220/718

[58] Field of Search ..... 220/254, 335, 220/713, 714, 715, 717, 718

[56] References Cited

U.S. PATENT DOCUMENTS 4,949,865 8/1990 Turner ..... 220/713

*Primary Examiner*—Joseph Man-Fu Moy

*Attorney, Agent, or Firm*—Lowe, Price, LeBlanc & Becker

[57] ABSTRACT

Disclosed is a cap for a drink container which permits drinking of the drink contained therein without removing the cap. The cap comprises a cover plate which is to cover the upper opening of the drink container and a peripheral wall of the cover plate which is to be fitted to the upper opening edge of the drink container. The cover plate is disposed diagonally in the peripheral wall and has a liquid port at a low position. A plugging member for closing the liquid port is pivotally supported on the upper surface of the cover plate substantially at the center thereof. The peripheral wall has a notch in which the plugging member is to be retracted when the liquid port is closed thereby. The plugging member is locked onto the cover plate when the liquid port is closed by the plugging member, whereas the plugging member is locked onto the peripheral wall when the liquid port is let open.

3 Claims, 3 Drawing Sheets

CAPS FOR DRINK CONTAINERS

BACKGROUND OF THE INVENTION AND RELATED ART STATEMENT

The present invention relates to a cap for a drink container, more particularly to a cap for a drink container which permits drinking of the drink contained in the container without opening the cap.

A cap for a drink container, which permits drinking of the drink contained in the container while the upper opening of the drink container is covered with a cover plate, is so far disclosed in U.S. Pat. No. Des. 289,955.

The cap disclosed in the U.S. Patent is a cover plate blocking the upper opening of the drink container. The cover plate has a flat portion and a slanted portion, with a liquid port and an air port being defined at a low position of the slanted portion and at the flat portion, respectively.

Accordingly, if the drink container is shaken or happens to fall down, the drink in the container may leak through the liquid port or air port.

OBJECT AND SUMMARY OF THE INVENTION

Therefore, it is an object of the invention to provide a cap for a drink container in which the drink contained in the drink container is prevented from leaking, even if the drink container is shaken or happens to fall down.

The cap for a drink container according to the present invention comprises a cover plate which covers the upper opening of the drink container and a peripheral wall of the cover plate to be fitted in the upper opening of the drink container. The cover plate is disposed diagonally in the peripheral wall and has a liquid port at a low position, and a plugging member for closing the liquid port is pivotally supported on the upper surface of the cover plate substantially at the center thereof. The peripheral wall has a notch into which the plugging member can be retracted, when the liquid port is let open.

The plugging member can be locked onto the cover plate when the liquid port is closed therewith; while the plugging member can be engaged with the peripheral wall when the liquid port is let open.

Accordingly, the drink in the container can be drunk through the liquid port by retracting the plugging member into the notch, applying the portion of the peripheral wall on the liquid port side to the mouth of a drinker and tilting the container. The drink in the container can also be taken using a straw which is inserted into the liquid port. The drink in the drink container can be prevented from leaking by closing the liquid port by the plugging member, even if the drink container should be shaken or fallen down.

Besides, the plugging member, if it is engaged with the notch, does not interferes with the drinker when he takes a sip.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

DETAILED DESCRIPTION OF PREFERRED EMBODIMENTS

The first embodiment of the invention will now be described referring to the attached drawings.

Figure 1:
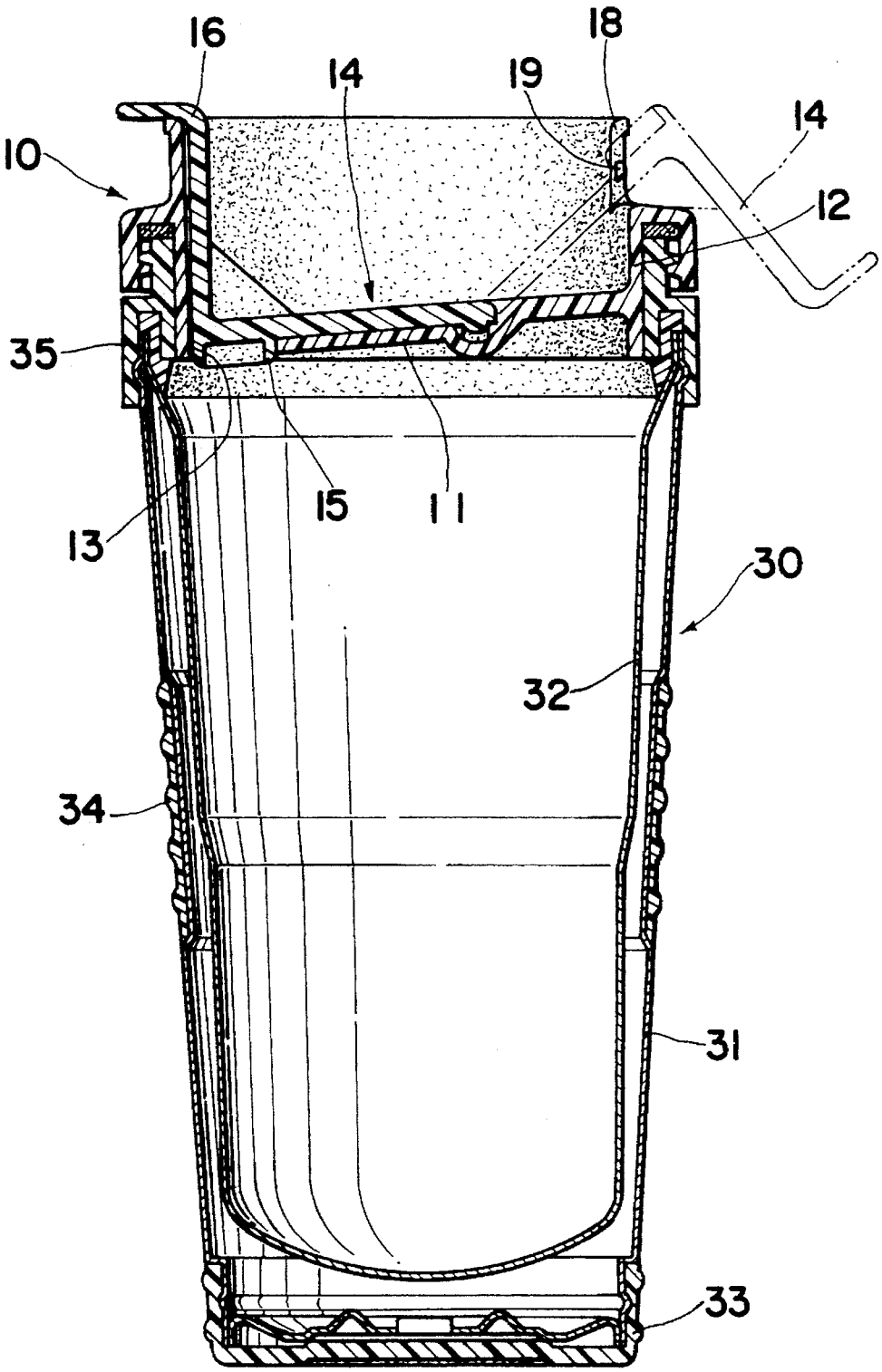
FIG. 1 is a cross-sectional view of the cap according to a first embodiment of the invention which is fitted to a drink container.
Figure 2:
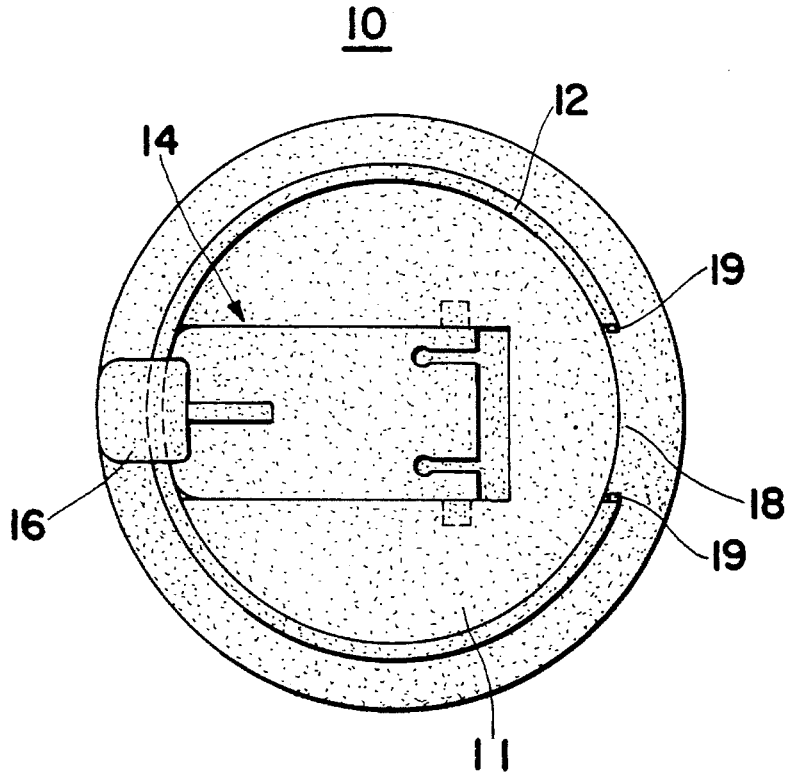
FIG. 2 is a plan view of the cap in which the liquid port is closed with a plugging member.
Figure 3:
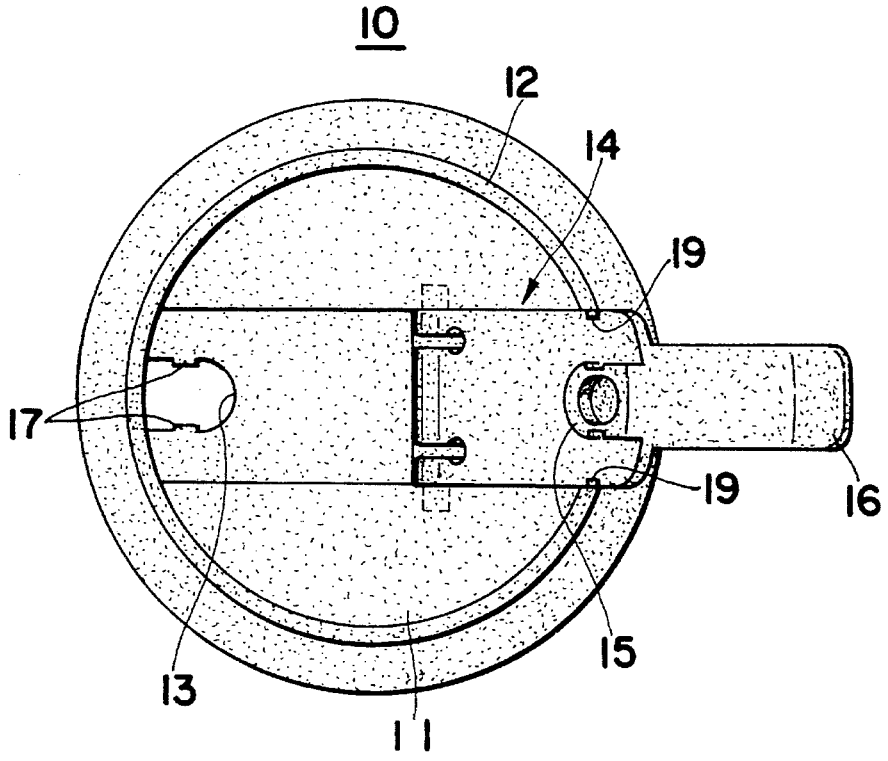
FIG. 3 is a plan view of the cap in which the plugging member is let open.

FIGS. 1 to 3 show a cap according to the first embodiment of the invention.

The reference number 10 denotes a cap to be fitted to the upper opening edge of a cup-like drink container 30. The cap 30 comprises a cover plate 11 which covers the upper opening of the drink container 30 and a peripheral wall 12 of the cover plate 11 to be fitted to the upper opening edge of the drink container 30.

The cover plate 11 is disposed diagonally in the peripheral wall 12, and a liquid port 13 is defined at a low position. A plugging member 14 having a substantially L-shaped cross section is pivotally supported onto the upper surface of the cover plate 11 substantially at the center thereof. The plugging member 14 has a plug 15 for closing the liquid port 13 and a tab 16.

A pair of protrusions 17 are provided on the inner circumference of the liquid port 13 of the cover plate 11, and these protrusions 17 serve to engage the plugging member 14 with the cover plate 11 when the liquid port 13 is closed by the plug 15 of the plugging member 14. These protrusions 17 may be provided on the plug 15 or on both of the inner circumference of the liquid port 13 and the plug 15.

The peripheral wall 12 has a notch 18 in which the plugging member 14 is to be retracted when it is let open. Meanwhile, a pair of projections 19 for retaining the plugging member 14 which is assuming an open posture are provided at that portion of the peripheral wall 12 which opposes to the notch 18. These projections 19 may be provided on the plugging member 14 or on both of the plugging member 14 and that portion of the peripheral wall 12 which opposes to the notch 18.

The drink container 30, which consists of an outer cup 31 and an inner cup 32, has a vacuum heat insulating structure therebetween. A bottoming member 33 is provided at the bottom of the outer cup 31. A non-slip 34 is provided on the circumference of the barrel of the outer cup 31. A shoulder member 35 is provided at the upper opening edge of the drink container 30.

The cap 10 can be fitted to the drink container 30 by screwing the peripheral wall 12 thereof into the shoulder member 35 or by other means.

Accordingly, in the state where the plug 15 of the plugging member 14 is closing the liquid port 13, the plug 15 is locked by the protrusions 17 to prevent the drink in the drink container from leaking therefrom. The drink contained in the drink container 30 can then be drunk by turning over the plugging member 14 to be retracted into the notch 18 and engaged with the projections 19, and tilting the drink container 30 after the portion of the peripheral wall 12 on the liquid port (13) side is applied to the mouth of a drinker. Alternatively, the drink can be taken using a straw which is inserted to the liquid port 13. Thus, the drink in the drink container 30 can be drunk without removing the cap 10 from the drink container 30.

Figure 4:
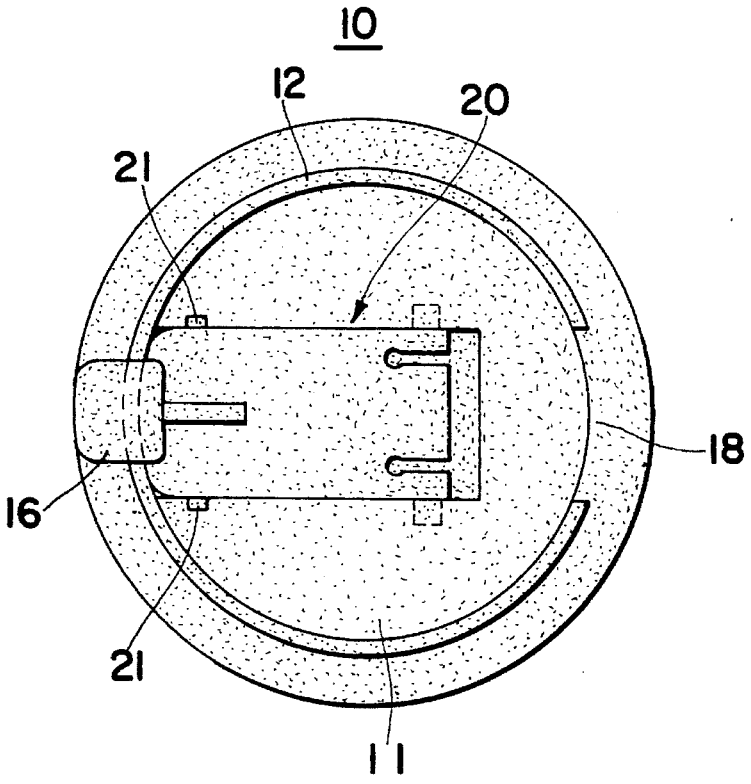
FIG. 4 is a plan view of the cap according to a second embodiment of the invention, in which the liquid port is closed with the plugging member.
Figure 5:
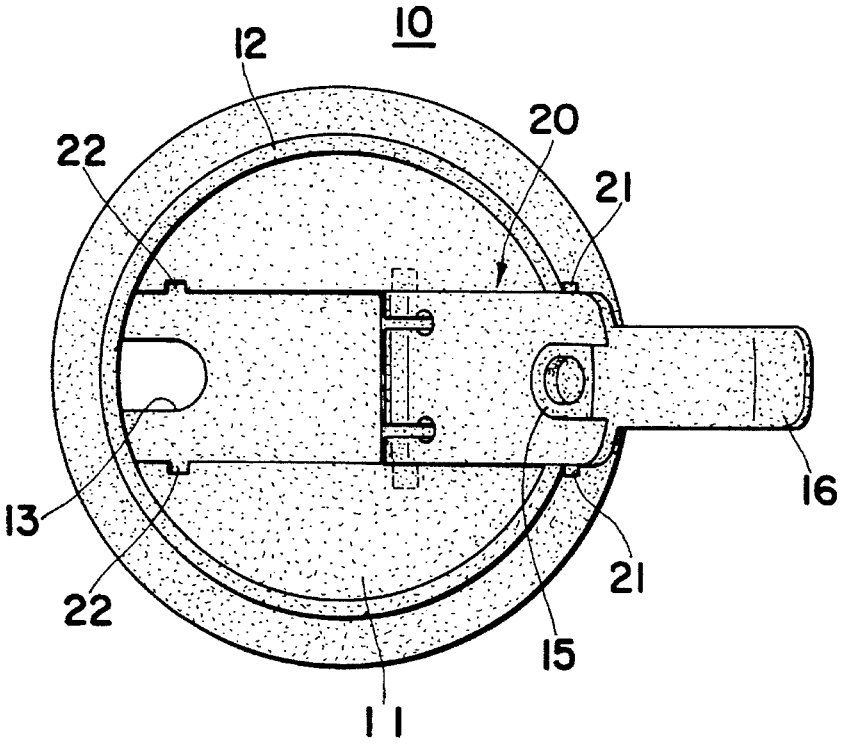
FIG. 5 is a plan view of the cap according to the second embodiment of the invention, in which the plugging member is let open.

FIGS. 4 and 5 show a cap according to a second embodiment of the invention.

In the second embodiment, a pair of protrusions 21 are provided on each side of a plugging member 20. These protrusions 21 of this plugging member 20 are engaged respectively with a pair of recesses 22 formed on the cover plate 11 when the plugging member 20 is closed; while they are engaged with the edge portions at the notch 18 of the peripheral wall when the plugging member 20 is let open. The other parts are of the same structure as in the first embodiment.

Although two embodiments of the present invention have been described herein, it should be apparent to those skilled in the art that the present invention may be embodied in many other specific forms without departing from the spirit or scope of the invention. Therefore, the present embodiments are to be considered as illustrative and not restrictive, and the invention is not to be limited to the details given herein, but may be modified within the scope of the appended claims.

What is claimed is:

1. A cap for a drink container, comprising a cover plate which is to cover an upper opening of said drink container and a peripheral wall of said cover plate which is to be fitted to an upper opening edge of said drink container; wherein said cover plate is disposed diagonally in said peripheral wall and has a liquid port at a low position thereof, an upper surface and a notch therein, with a plugging member for closing said liquid port being pivotally connected in said notch on the upper surface of said cover plate substantially at the center thereof; and said peripheral wall is provided with a notch in which said plugging member assuming an open posture is to be retracted, wherein said upper surface of the cover plate between said notch and said liquid port is in direct surface contact with said plugging member when the liquid port is closed, and said pivotal connection does not extend above said upper surface of said cover plate.

2. The cap for a drink container according to claim 1, wherein said plugging member is engaged with said cover plate when said liquid port is closed by said plugging member.

3. The cap for a drink container according to claim 1, wherein said plugging member is engaged with said peripheral wall when said liquid port is opened.

* * * * *